US008528451B2

(12) United States Patent
Steineckert et al.

(10) Patent No.: US 8,528,451 B2
(45) Date of Patent: Sep. 10, 2013

(54) TOOL HAVING AN INTEGRAL CARABINER

(75) Inventors: Jennefer Ruth Steineckert, Portland, OR (US); Benjamin C. Rivera, Lake Oswego, OR (US)

(73) Assignee: Leatherman Tool Group, Inc., Portland, OR (US)

( * ) Notice: Subject to any disclaimer, the term of this patent is extended or adjusted under 35 U.S.C. 154(b) by 402 days.

(21) Appl. No.: 12/624,823

(22) Filed: Nov. 24, 2009

(65) Prior Publication Data

US 2011/0119834 A1 May 26, 2011

(51) Int. Cl.
*B25F 1/04* (2006.01)

(52) U.S. Cl.
USPC ..... 81/427.5; 30/155; 7/167; 7/128

(58) Field of Classification Search
USPC ..... 81/427.5, 177.4, 490; 7/158, 168, 7/118, 128–135; 30/123, 158–161, 153, 30/155, 164; 16/110.1, 111.1
See application file for complete search history.

(56) References Cited

U.S. PATENT DOCUMENTS

| | | | | |
|---|---|---|---|---|
| 6,470,522 | B2 * | 10/2002 | Veltz et al. | 7/128 |
| 6,594,906 | B1 * | 7/2003 | Sakai et al. | 30/155 |
| 7,000,323 | B1 * | 2/2006 | Hatcher et al. | 30/155 |
| 7,676,931 | B2 * | 3/2010 | Knight et al. | 30/158 |
| 7,712,399 | B2 * | 5/2010 | Nenadic | 81/427.5 |
| D626,810 | S * | 11/2010 | Steineckert et al. | D8/55 |
| 7,913,591 | B2 * | 3/2011 | Nenadic | 81/427.5 |
| 8,087,115 | B2 * | 1/2012 | Barber et al. | 7/167 |
| 2005/0144730 | A1 * | 7/2005 | Barber et al. | 7/138 |
| 2005/0246874 | A1 | 11/2005 | Hsu | |

OTHER PUBLICATIONS

Office Action for Australian Application No. 2010241444; dated Mar. 20, 2012.
Office Action for Canadian Application No. 2,720,941; dated Sep. 5, 2012.

* cited by examiner

*Primary Examiner* — Monica Carter
*Assistant Examiner* — Melanie Alexander
(74) *Attorney, Agent, or Firm* — Alston & Bird LLP

(57) ABSTRACT

A tool, such as a multipurpose tool, is provided that includes a carabiner having a spring that is configured to be sufficiently rugged to withstand the anticipated utilization of the carabiner. The tool may include at least a first handle, including a carabiner defining an opening thereto, and at least one tool carried by the first handle. The tool may also include a spring connected to the first handle proximate the carabiner and a gate urged by the spring to extend at least partially across the opening defined by the carabiner. The first handle may also include a tab, and the spring may include a corresponding engagement member configured to engage the tab such that the tab resists movement of the spring relative to the first handle. A corresponding handle assembly may also be provided.

24 Claims, 9 Drawing Sheets

TOOL HAVING AN INTEGRAL CARABINER

FIELD OF THE INVENTION

Embodiments of the present invention relate generally to tools and, more particularly, to a tool, such as a multipurpose tool, having an integral carabiner and a handle, such as the handle of a tool, having an integral carabiner.

BACKGROUND OF THE INVENTION

Multipurpose tools are widely popular for their utility in a substantial number of different applications. As its name suggests, a multipurpose tool includes a number of tools carried by common frame. A multipurpose tool may include different combinations of tools depending upon its intended application. For example, multipurpose tools that are designed for a more universal or generic application can include pliers, a wire cutter, a bit driver, one or more knife blades, a saw blade, a bottle opener or the like. Other multipurpose tools are designed to service more specific applications or niche markets and correspondingly include tools that are useful for the intended application. For example, multipurpose tools may be specifically designed for automobile repairs, hunting, fishing or other outdoor applications, gardening, and the like.

One reason for the popularity of multipurpose tools is the capability provided by a multipurpose tool to provide a wide range of functionality with a single tool, thereby reducing the need to carry a number of different tools to perform those same functions. For example, a single multipurpose tool may be carried instead of a pair of pliers, one or more screwdrivers, a knife and a bottle opener. As such, the burden upon a user is reduced since the user need only carry a single multipurpose tool.

As multipurpose tools are frequently carried by users in the field, it is desirable for the multipurpose tools to be relatively small and lightweight while remaining rugged so as to resist damage. In order to reduce the overall size of a multipurpose tool, some multipurpose tools have been designed to be foldable. In this regard, foldable multipurpose tools are designed to move between a closed position and an open position. Generally, the closed position is more compact with the multipurpose tool frequently being carried in the closed position. Conversely, while the open position is generally less compact than the closed position, the open position generally allows the deployment of one or more of the tools that are stowed and relatively inaccessible when the multipurpose tool is in the closed position.

For example, a multipurpose tool may include pliers or scissors having a pair of jaws connected to respective handles. In the open position, the pliers or scissors are deployed and capable of being actuated by movement of the handles toward and away from one another. In the closed position, the handles may be folded about the pliers or scissors such that the pliers or scissors are no longer functional. In the closed position, however, the multipurpose tool is more compact with the form factor generally defined by the proximal relationship of the handles.

It is often desirable for a multipurpose tool to include a carabiner. Among other uses, a carabiner having a spring-loaded gate can be employed to clip the multipurpose tool to a belt loop or to otherwise secure the multipurpose tool to the user. As it will be apparent, the secure engagement of the multipurpose tool to the user that is provided by a carabiner is particularly useful since multipurpose tools are frequently carried by the user in the field and may become misplaced or otherwise be difficult to locate. A carabiner may be utilized frequently with the spring-loaded gate being repeatedly opened and closed in order to permit the carabiner to be repeatedly engaged and disengaged. Because of the repeated use of the carabiner and the force applied to the gate and the other components of the carabiner in order to permit the carabiner to be engaged and disengaged, it would be desirable for the carabiner, including each of its constituent components, to be sufficiently rugged to withstand the forces repeatedly imparted to the carabiner, thereby permitting reliable and long lasting operation. In some instances, however, the repeated use of the carabiner may cause one or more of the components of a carabiner to be displaced, thereby disadvantageously altering the operation of the carabiner. For example, the spring that urges or biases the gate to a closed configuration in the absence of an externally applied force may move or shift relative to the handle of the tool, thereby disadvantageously altering the operation of the carabiner, such as by disadvantageously altering the manner in which or the extent to which the gate is biased into a closed position.

As such, it would be desirable to design a tool, such as a multipurpose tool, having a carabiner that is sufficiently rugged to withstand its repeated engagement and disengagement and the corresponding repeated application of forces thereto. In this regard, it would be desirable to design a tool, such as a multipurpose tool, having a carabiner in which the components of the carabiner remain in a fixed position relative to other components of the carabiner and/or other components of the tool, such as the handle of the tool, in order to facilitate continued reliable operation of the carabiner.

BRIEF SUMMARY OF THE INVENTION

According to one embodiment, a tool, such as a multipurpose tool, is provided that includes a carabiner that is configured to be sufficiently rugged to withstand the anticipated utilization of the carabiner. In this regard, the carabiner may be designed such that the spring of the carabiner is more reliably and stably positioned relative to the handle in order to facilitate the continued dependable operation of the carabiner. In another embodiment, a corresponding handle is provided that has a carabiner with a reliably positioned spring for biasing the gate to a closed position.

A multipurpose tool of one embodiment includes a plurality of handles configured for relative movement between a closed position and an open position. The plurality of handles include at least a first handle having a carabiner defining an opening thereto. The multipurpose tool also includes a plurality of tools carried by at least one of the handles. Further, the multipurpose tool includes a spring connected to the first handle proximate the carabiner and a gate urged by the spring to extend at least partially across the opening defined by the carabiner. In this embodiment, the first handle also includes a tab, and the spring includes a corresponding engagement member configured to engage the tab such that the tab resists movement or a spring relative to the first handle. Thus, the multipurpose tool of this embodiment facilitates the stable positioning of the spring relative to the first handle in order to facilitate continued reliable operation of the carabiner.

In another embodiment, a tool is provided that includes at least a first handle, including a carabiner defining an opening thereto, and at least one tool carried by the first handle. The tool also includes a spring connected to the first handle proximate the carabiner and a gate urged by the spring to extend at least partially across the opening defined by the carabiner. According to this embodiment, the first handle also includes a tab, and the spring includes a corresponding engagement member configured to engage the tab such that the tab resists movement of the spring relative to the first handle.

In a further embodiment, a handle assembly is provided that includes a frame having first and second sidewalls spaced apart from and operably connected to one another. The frame includes a carabiner defining an opening thereto. The handle assembly also includes a spring connected to the frame proximate the carabiner and a gate urged by the spring to extend at least partially across the opening defined by the carabiner. According to one embodiment, the frame also includes a tab, and the spring includes a corresponding engagement member configured to engage the tab such that the tab resists movement of the spring relative to the frame.

In embodiments in which the handle or frame of the multipurpose tool, the tool and/or the handle assembly includes first and second sidewalls, the tab may be disposed between the first and second sidewalls. For example, the frame may include an interconnect extending between the first and second sidewalls, with the tab being connected to and extending from the interconnect. In this regard, the tab may extend in a direction from the interconnect toward the carabiner. The interconnect of one embodiment may extend between the respective edges of the first and second sidewalls, while the tab may be disposed interior of the respective edges and between medial portions of the first and second sidewalls. In one embodiment, the spring may be positioned at least partially between the first and second sidewalls of the frame. In this embodiment, the engagement member of the spring may extend in a direction away from the carabiner.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
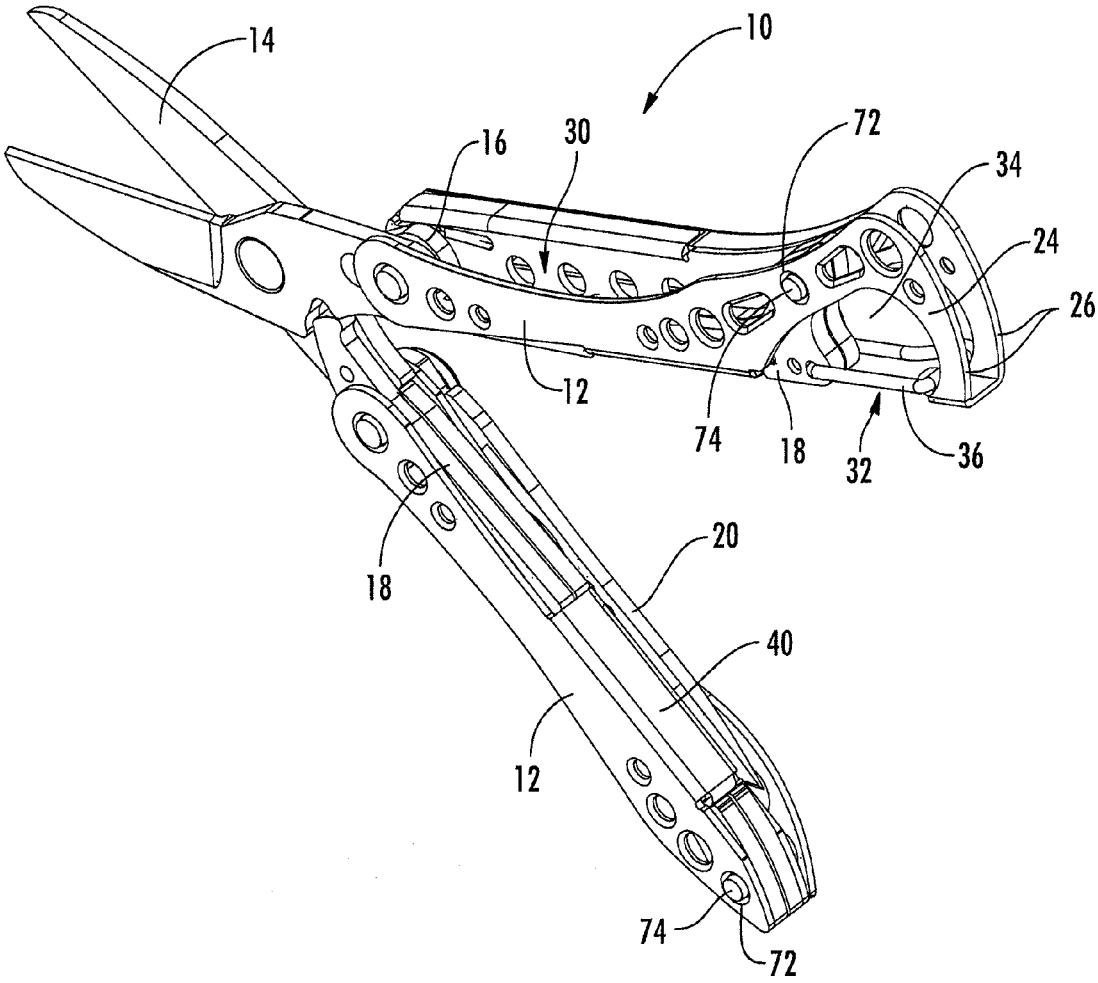
FIG. 1 is a perspective view of a multipurpose tool according to an embodiment of the present invention in the open position.
Figure 2:
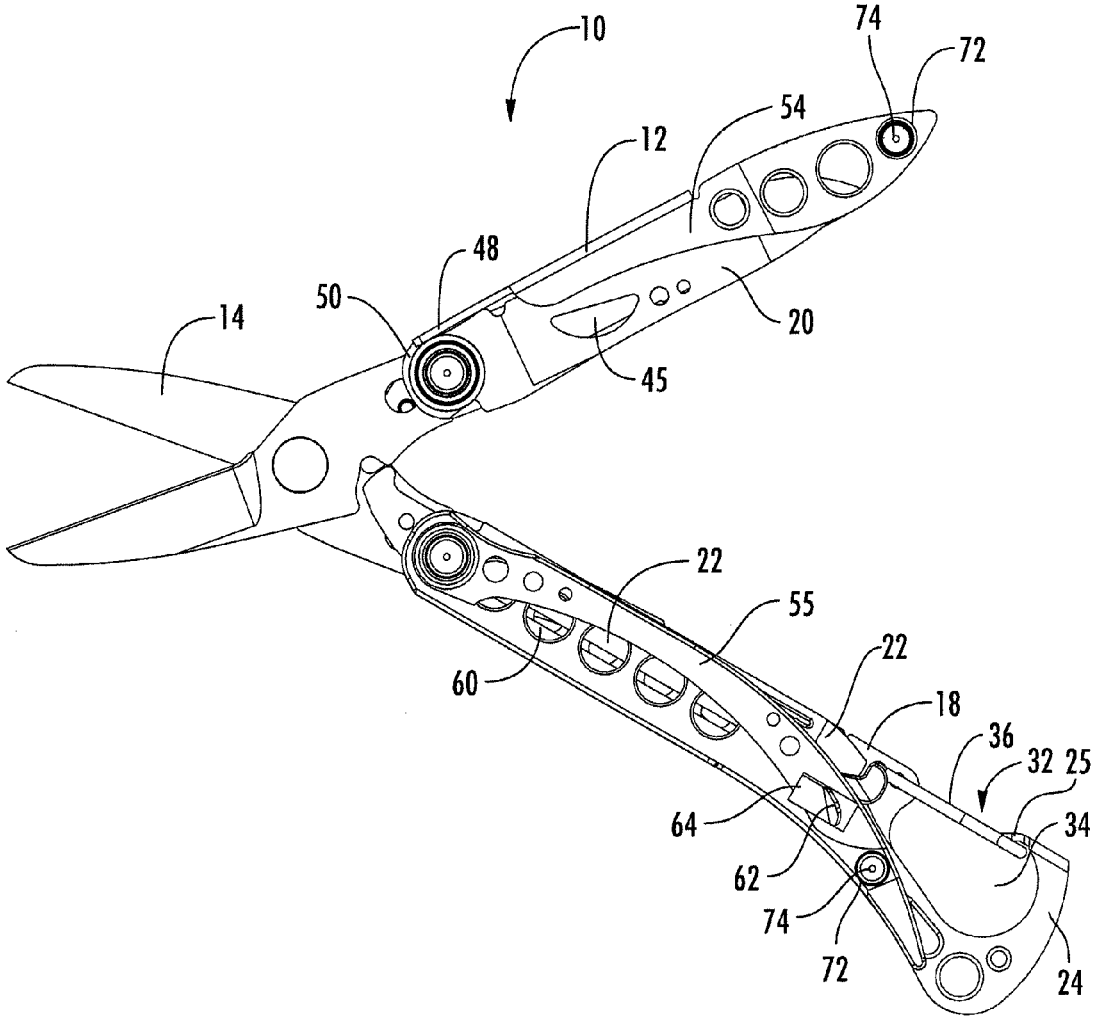
FIG. 2 is a view of a first side of the multipurpose tool of FIG. 1.
Figure 3:
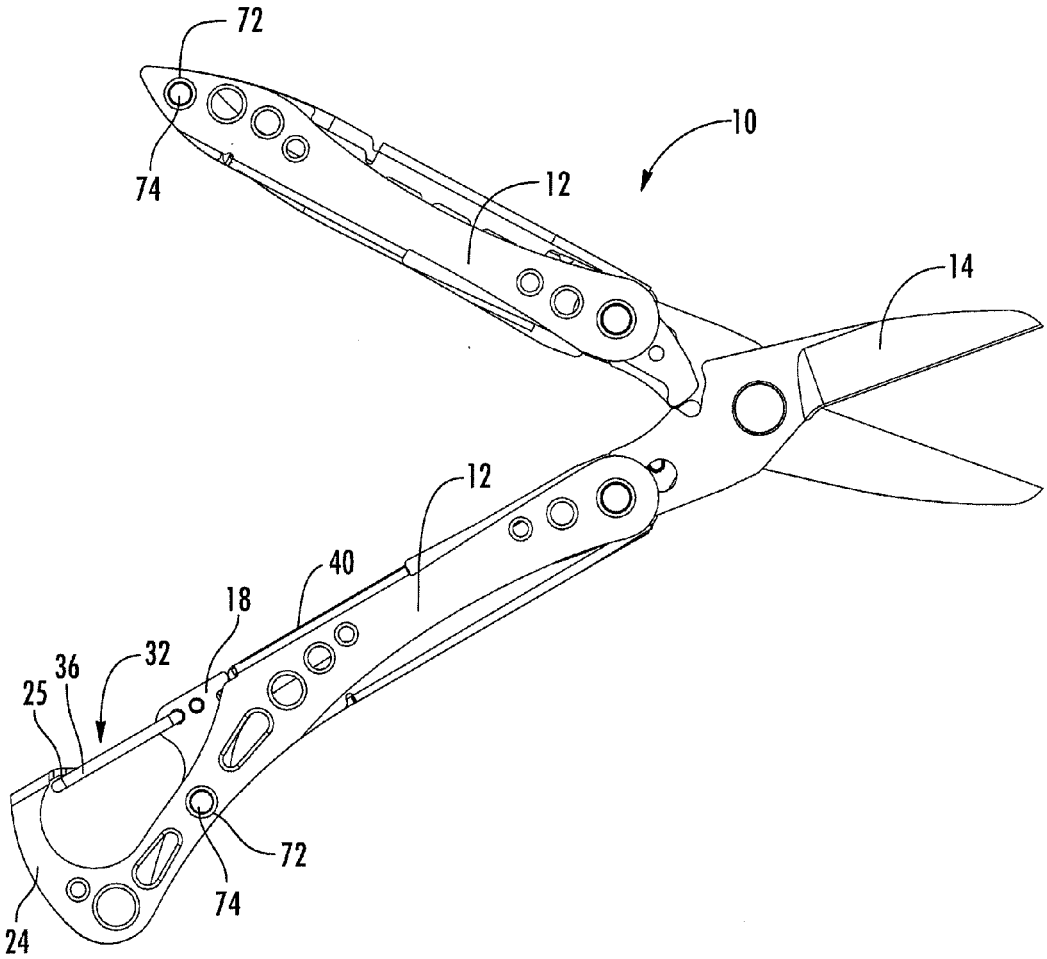
FIG. 3 is a view of a second side of the multipurpose tool of FIG. 1, opposite the first side shown in FIG. 2.

Referring now to FIGS. 1-3, a tool, such as a multipurpose tool 10, according to one embodiment of the present invention is depicted. While the tool will be described in the context of a multipurpose tool, other types of tools may readily employ embodiments of the present invention including knives and other tools that are not considered multipurpose tools. For purposes of illustration, but not of limitation, a multipurpose tool employing an embodiment of the present invention will now be described.

The multipurpose tool 10 includes a plurality of handles 12 configured for movement relative to one another, as well a plurality of tools carried by at least one of the handles. Typically, the multipurpose tool includes a pair of generally elongate handles that extend between opposed ends. As a result of their connection, such a pivotal connection, to one another and/or to one or more of the tools, the handles can be moved toward and away from one another, such as in order to actuate a tool as described below.

As also described below, the multipurpose tool 10 may be configured such that the handles 12 are adapted for relative movement between an open position as shown in FIGS. 1-3 and a closed position as shown in FIGS. 4-7 and discussed hereinafter. As will be apparent, the multipurpose tool has a compact form factor in the closed position so as to facilitate transport and storage of the multipurpose tool. While the multipurpose tool is more expansive in the open position, one or more of the tools of the multipurpose tool are accessible and capable of being utilized in the open position, even though those same tool(s) are stowed and generally inaccessible in the closed position.

With reference to FIGS. 1-3, a multipurpose tool 10 of one embodiment may include first and second handles 12 that are connected to the opposed jaws of a tool 14 having pivotable jaws, such as the scissors of the illustrated embodiment. In the open configuration, the handles may be moved toward one another to a position shown in FIG. 1 in order to close the jaws of the scissors and away from one another in order to open the jaws of the scissors. In one embodiment, the jaws of the scissors are configured to contact one another once the jaws are in a fully opened position in order to prevent further opening of the jaws.

Figure 4:
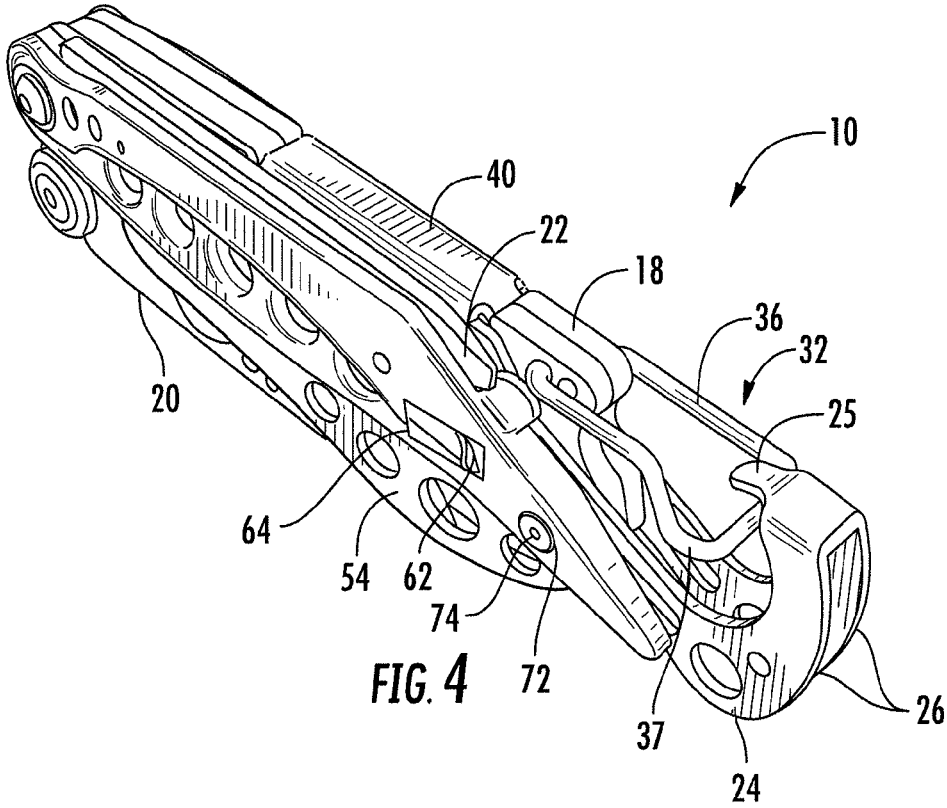
FIG. 4 is a perspective view of the first side of the multipurpose tool of FIG. 1 in the closed position.
Figure 5:
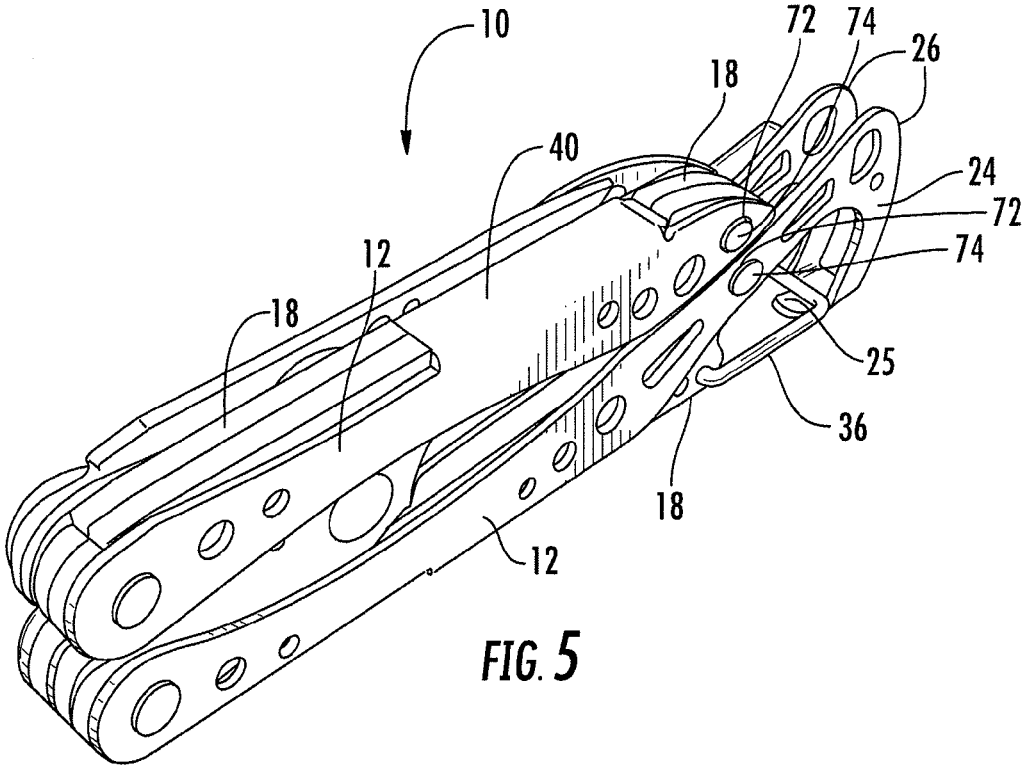
FIG. 5 is a perspective view of the second side of the multipurpose tool of FIG. 1 in the closed position.
Figure 6:
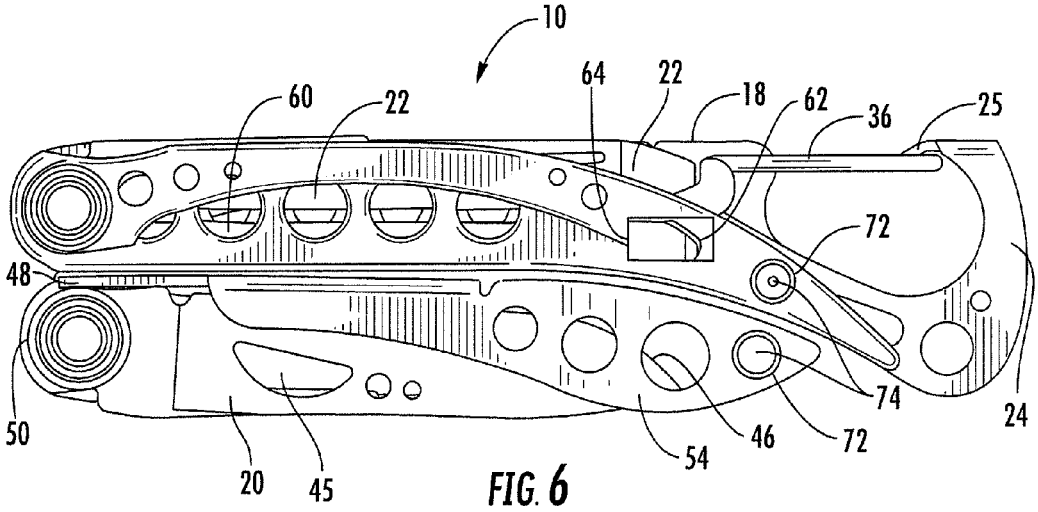
FIG. 6 is a view of the first side of the multipurpose tool of FIG. 4.
Figure 7:
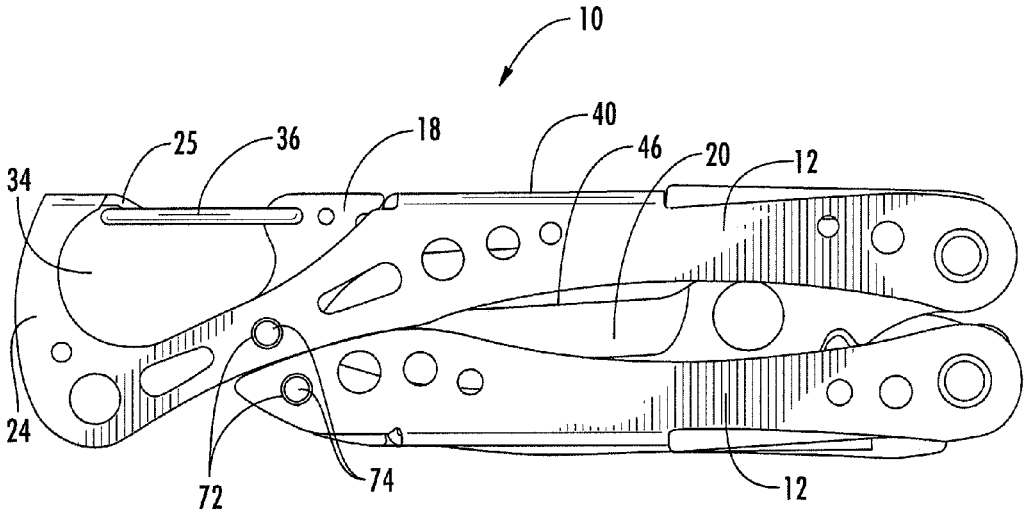
FIG. 7 is a view of the second side of the multipurpose tool of FIG. 5.

Even though the jaws cannot be opened any further, the handles 12 can be pivoted relative to the respective jaws in order to transition from the open position as shown in FIG. 1 to the closed position as shown in FIGS. 4 and 5. Although the handles may be connected to the jaws in a variety of different manners, the pivotable connection between the handles and jaws may incorporate a camming mechanism in order to bias the handles to remaining in either the open or closed positions. For example, those portions of the jaws that are pivotally connected to the handles may serve as eccentric cams 16 and the handles may include one or more corresponding spring members 18 that ride upon the cams. In one embodiment, each handle may include a pair of spring members for cooperating with the cam to resist the pivotal movement of the handle relative to the respective jaw that is required to initiate the transition from the open position to the closed position or, conversely, from the closed position to the open position without the application of additional force. In the embodiment depicted in FIG. 1, for example, the spring members extend lengthwise along the respective handle and engage the cam of the respective jaw at one end of the respective handle. In order to transition the multipurpose tool 10 from the open position to the closed position, force would initially be applied to the handles to move the handles further away from one another until the jaws are fully opened. Then, with the application of an additional and larger force in a direction intended to move the opposite ends of the handles further away from one another, the resistance provided by the combination of the cams and the spring members can be overcome with the ends of the spring members that are proximate the cams being deflected by the cams relative to the remainder of the handle in order to permit pivotal movement of the handles relative to the jaws.

As will be observed, the cams 16 and the spring members 18 can also be configured to provide a comparable force opposing movement of the multipurpose tool 10 from a closed position to the open position that can be similarly overcome by the application of additional force so as to pivot the handles relative to the jaws. The camming mechanism incorporated into the pivotable connection between the handles 12 and the jaws thereby reduces the likelihood that the multipurpose tool will be inadvertently transitioned between the open and closed positions.

Figure 8:
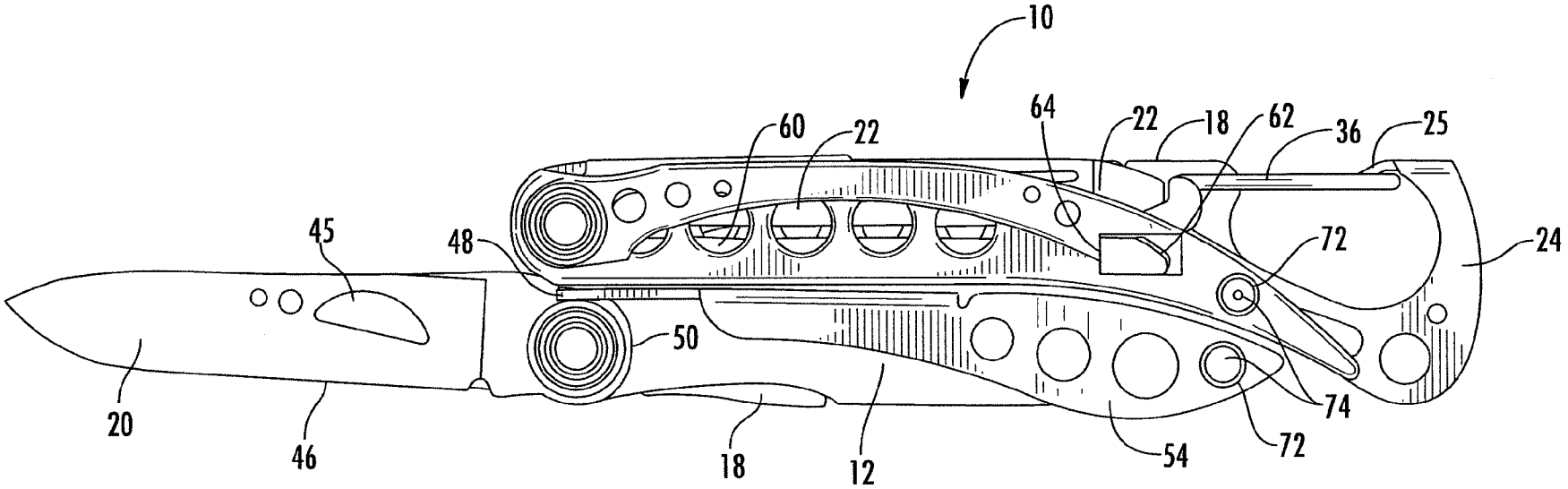
FIG. 8 is a view of the first side of the multipurpose tool of FIG. 4 with the knife blade deployed.
Figure 9:
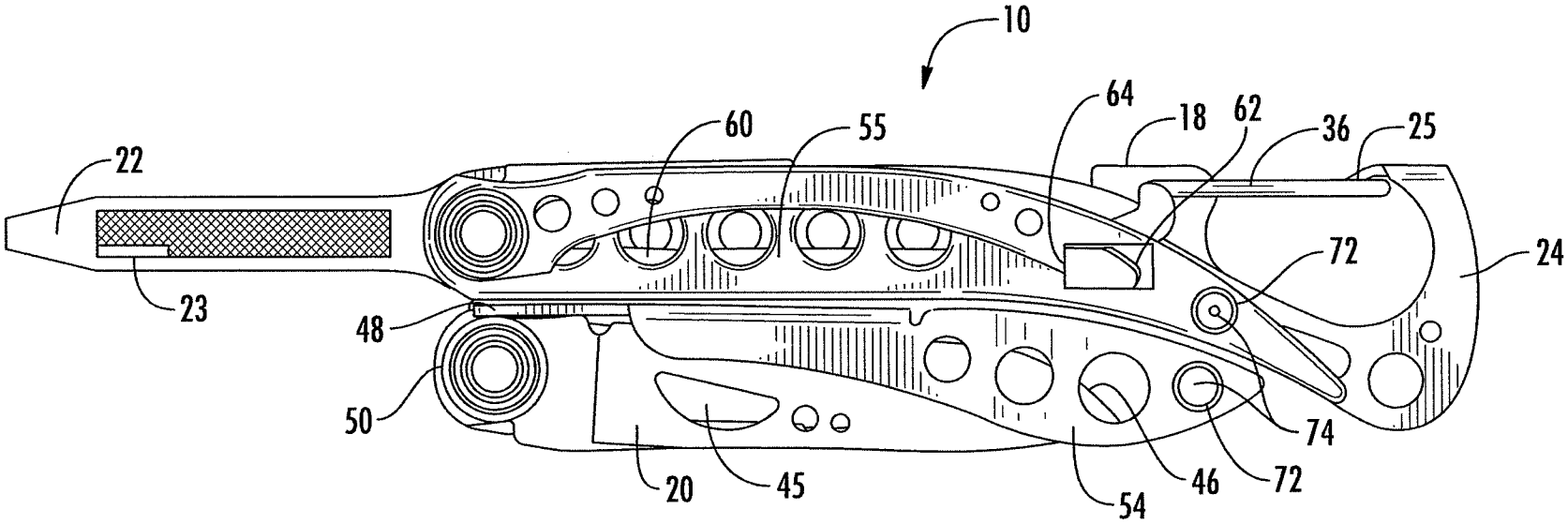
FIG. 9 is a view of the first side of the multipurpose tool of FIG. 4 with the screwdriver/file deployed.

The multipurpose tool 10 can include a variety of tools. For example, the multipurpose tool can include a tool 14 having pivotable jaws, such as the scissors described above. Although not heretofore described, the tool having pivotable jaws can also include wire cutters and/or wire strippers, if desired. Additionally, the multipurpose tool of the embodiment depicted in FIGS. 1-3 includes a knife blade 20 and a combination screwdriver/file 22 carried by the handle 12. Other embodiments of the multipurpose tool can include these tools and/or other tools, such as a bit driver, saw blade, bottle opener, can opener, saw, razor, gut hook or the like. With reference to the illustrated embodiment, the knife blade and the combination screwdriver/file can be pivotally connected to respective ones of the handles so as to be unfolded to a deployed position as shown in FIGS. 8 and 9, respectively, particularly in instances in which the multipurpose tool is in the closed configuration.

The multipurpose tool 10 of this embodiment also includes a carabiner 24 for permitting the multipurpose tool to be removably secured to another object, such as a belt loop, key ring or the like. The carabiner is configured to move in concert with one of the handles 12 and is typically formed by the respective handle, such as at one end thereof.

As shown in FIG. 1, the carabiner 24 includes first and second sidewalls 26 that are spaced from one another. As will be described hereinafter, the first and second sidewalls also generally define a portion of the handle 12, such as a frame, so as to permit the handle including an integral carabiner to be fabricated in an efficient manner. Thus, the carabiner moves in concert with the handle and is generally not movable relative to the remainder of the handle, i.e., is incapable of movement independent of the remainder of the handle. As shown, the first and second sidewalls are spaced apart from one another such that at least portions of the first and second sidewalls define an externally accessible gap 30 therebetween. As described below, the spacing of the first and second sidewalls and, therefore, the size of the gap therebetween is selected so as to receive, either entirely or at least partially, the spring member(s) 18.

Although the first and second sidewalls 26 are spaced from one another, one or more portions of the first and second sidewalls may be interconnected. For example, intermediate portions of the first and second sidewalls, that is, portions of the first and second sidewalls spaced apart and positioned between the opposed ends of the respective handle 12, may be interconnected with interconnect 40, albeit at some distance spaced apart from the carabiner. However, other portions of the first and second sidewalls are free of any direct connection, as also discussed below.

The carabiner 24 defines an opening 32 into an engagement aperture 34 with the engagement aperture being accessible through both the first and second sidewalls 26. In this regard, the object to which the multipurpose tool 10 is desirably attached may be inserted through the opening into the engagement aperture such that the carabiner is effectively clipped to the object. In order to secure the object within the engagement aperture, the carabiner can also include a gate 36 that extends across the opening defined by the carabiner. While the carabiner can include a variety of gates, the carabiner of one embodiment includes a gate that is pivotally connected, at one end, to the spring member(s) 18. In this regard, the gate may be spring loaded so as to close the opening in the absence of any applied force. Although the gate can be pivotally connected to the handle in various manners, the gate of the illustrated embodiment is a rectangular hoop that is pivotally connected to one end of the spring members 18 of the handle, namely, the ends of the spring members opposite the camming mechanism. As illustrated, the gate may include an outwardly extending portion 37 for facilitating user engagement of the gate.

In one embodiment, the carabiner 24 may also include an integral bottle opener. As shown, the carabiner may include an inwardly turned lip 25 proximate the opening 32 defined by the carabiner. In order to open a bottle, the bottle cap may be inserted through the opening, thereby displacing the gate 36, such that the lip engages the bottle cap and permits the transfer of force thereto by the user.

As shown in FIG. 8, the multipurpose tool 10 of the illustrated embodiment can include a knife blade 20 that can be extended, particularly when the multipurpose tool is in the closed position. As shown, the knife blade is configured to pivotally rotate relative to the handle 12 that carries the knife blade. In order to facilitate the rotation of the knife blade from its stowed position, the knife blade can define an opening 45, typically opposite the cutting edge 46, that a user can grasp in order to rotate the knife blade outwardly away from the handle. In order to bias the knife blade to remain in the fully opened position, the multipurpose tool and, in particular, the frame of the handle that carries the knife blade can include a spring 48 that engages the rear portion 50 of the knife blade, which is formed as and serves as a camming surface. In order to prevent access to the cutting edge of the knife blade while the knife blade is in a folded position, the handle that carries the knife blade can also include a guard 54 attached or otherwise integral to the frame of the respective handle such that the guard covers the cutting edge of the knife blade while the knife blade is in a folded position.

The combination screwdriver/file 22 can also be extended, particularly when the multipurpose tool 10 is in the closed position. As shown in FIG. 9, the screwdriver/file is configured to pivotally rotate relative to handle 12 that carries the screwdriver/file. In order to facilitate the rotation of the screwdriver/file from its stowed position, the screwdriver/file can define a notch 23 that a user may engage in order to rotate the screwdriver/file outwardly away from the handle. In order to bias the screwdriver/file to remain in the fully opened position, the multipurpose tool and, in particular, the frame of the handle that carries the screwdriver/file can include a spring that engages a rear portion of the screwdriver/file, which is formed as and serves as a camming surface. The handle that carries the screwdriver/file can also include a guard or scale 55 attached or otherwise integral to the frame of the respective handle such that the guard covers a majority of the screwdriver/file while the screwdriver/file is in a folded position. As described below, the guard may be advantageously attached to or formed relative to the remainder of the frame of the respective handle so as to define an interior pocket or other space between the guard and the remainder of the frame, both to receive the screwdriver/file in the folded position and to receive a pair of tweezers 60, in on embodiment.

Figure 10:
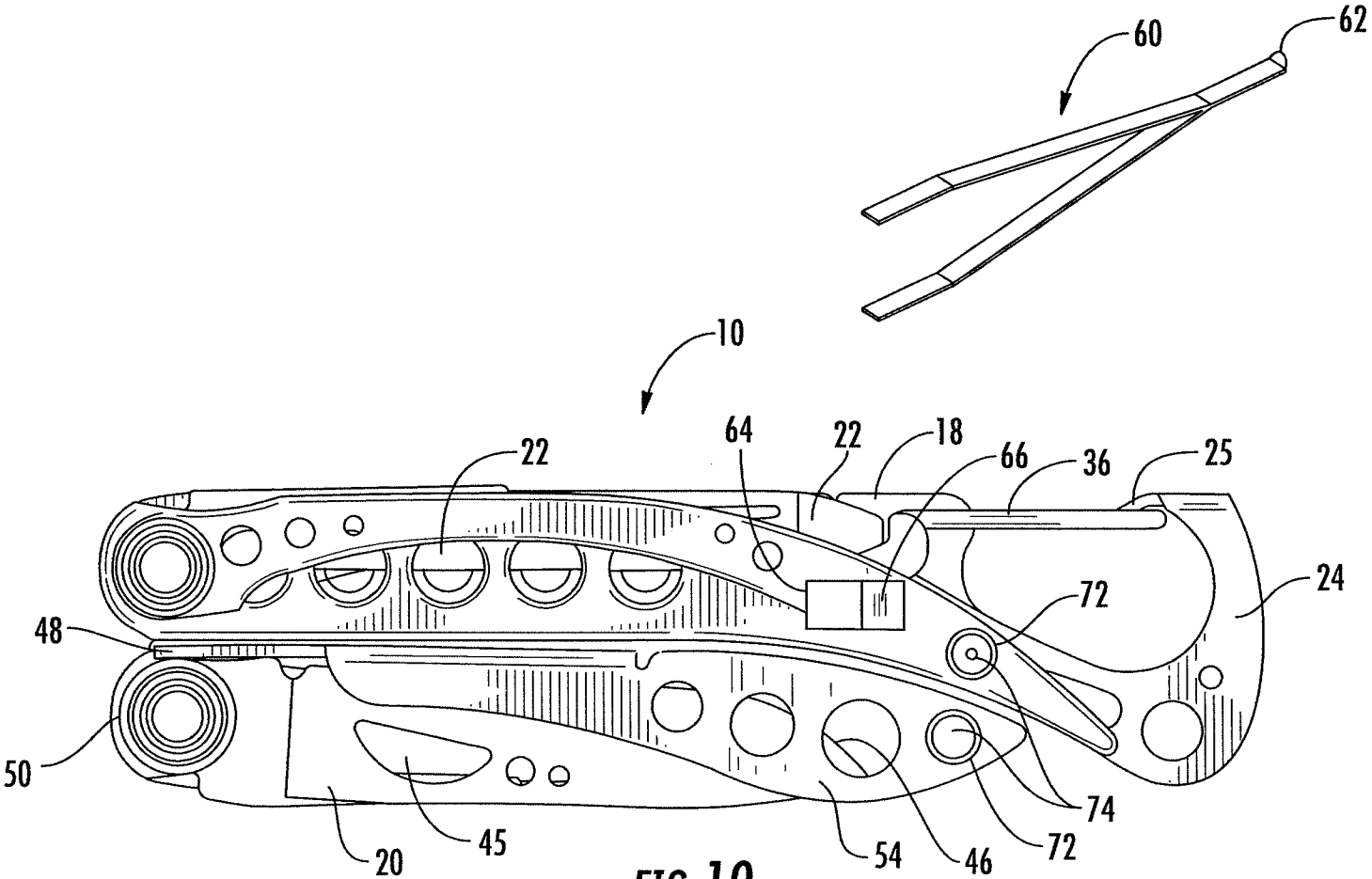
FIG. 10 is a view of the first side of the multipurpose tool of FIG. 4 with the tweezers removed.

In this regard, the multipurpose tool 10 of the illustrated embodiment also includes a pair of tweezers 60. In this regard, the frame of a respective handle 12 may define an interior pocket or other space, such as between the guard or scale 55 and the remainder of the frame of the respective handle. Indeed, an interior surface of the guard of one embodiment may define an interiorly facing channel for receiving the tweezers. The guard of this embodiment may also define an opening 64 into the pocket such that a pair of tweezers may be inserted through the opening into the pocket. In order to facilitate the insertion of the tweezers, the opening may define and angled surface 66 as shown in FIG. 10 that serves to guide the tweezers through the opening and into the pocket. As such, the angled surface effectively tapers in a direction toward the pocket relative to the opening thereto. In the embodiment in which the guard defines an interiorly facing channel, the opening and the angled surface may be aligned with the channel so as to direct the tweezers into the channel. In order to facilitate removal of the tweezers, one end of the tweezers as shown in FIG. 10 may include an outwardly turned portion 62 that may be engaged by a user in order to withdraw the tweezers from the pocket. Once the user has completed their use of the tweezers, however, the tweezers may be reinserted through the opening into the pocket and thereafter carried by the multipurpose tool.

In order to construct one embodiment of the handle 12 that carries the carabiner 24, one or more spring members 18 may be positioned between the first and second sidewalls 26 of the frame. The first and second sidewalls of the frame can also define one or more openings 72 for receiving fasteners 74 for securing the frame to one or more spring members 18 and, more typically, to the end of the spring members opposite the camming mechanism of the pivotable jaws. As such, the spring members may be positioned such that openings defined by the end of the spring members opposite the camming mechanism are aligned with the corresponding openings 72 defined by the frame. The spring members may then be secured to the frame by means of fasteners 74 that extend through the aligned openings. The other end of the spring members has no direct connection to the frame so as to permit deflection of the spring members as the spring members contact and ride upon the cams of the jaws. As described above, the gate 36 that extends across the opening 32 defined by the carabiner may also be connected to and extend from the end of the spring members that is connected to the frame.

Figure 11:
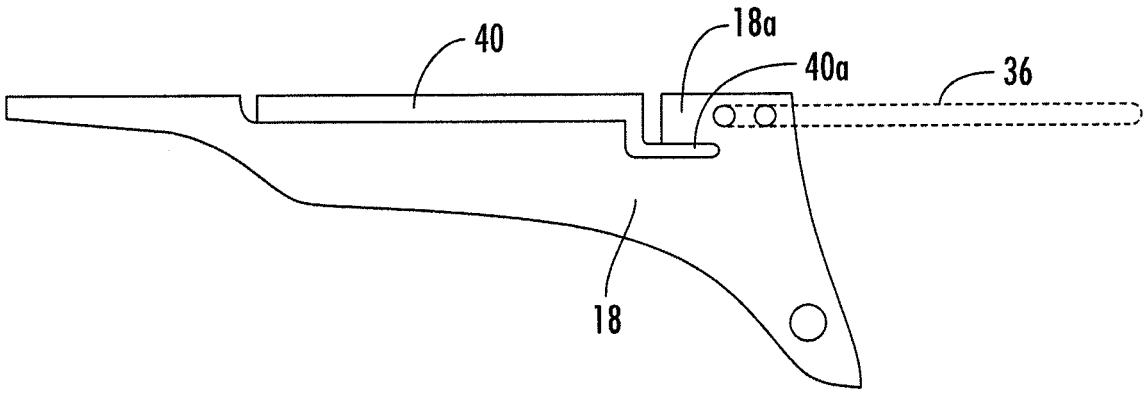
FIG. 11 is a side view of the interconnect and the spring illustrating the relationship of the tab of the interconnect and the engagement member of the spring in accordance with one embodiment.

As shown in FIG. 11 which illustrates the relationship of the spring members 18 and the interconnect 40, the spring members advantageously engage a tab 40*a* carried by the frame. In the illustrated embodiment, for example, the tab extends toward the carabiner 24 from the interconnect 40. In this regard, the interconnect may join respective edges of the first and second sidewalls 26 of the frame, while the tab is L-shaped and positioned so as to be spaced apart from the edges of the first and second sidewalls and within an interior region between medial portions of the first and second sidewalls. Correspondingly, the spring members may include an engagement member 18*a* that engages the tab, such as by resting upon and contacting the tab. As such, the tab serves to further support the spring member, particularly as force is applied to the gate 36 and, in turn, to the spring member to open the gate. This support provided by the tab is advantageous in that the tab serves to reliably position the spring members relative to the frame and, in turn, the carabiner. Additionally, the interaction of the tab and the spring members increases the rigidity of the spring members and prevents or at least limits relative movement of the spring members with respect to the frame over the course of time and usage. Thus, the spring members of this embodiment will continue to reliably function as the forces that are repeatedly applied to the spring members in response to opening the gate are at least partially supported and offset by the tab and, in turn, the frame from which the tab extends. Thus, the reliability of the spring members and, in turn, the multipurpose tool 10 itself may be improved.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A multipurpose tool comprising:

a plurality of handles configured for relative movement between a closed position and an open position, wherein at least a first handle includes a carabiner defining an opening thereto, and wherein the first handle is elongate so as to extend in a lengthwise direction between opposed ends;

a plurality of tools carried by at least one of the handles;

a spring extending in the lengthwise direction and connected to the first handle proximate the carabiner; and a gate engaged by the spring to extend at least partially across the opening defined by the carabiner, wherein the first handle also includes a tab that extends in the lengthwise direction and the spring includes a corresponding engagement member configured to engage the tab such that the tab resists movement of the spring relative to the first handle.

2. A multipurpose tool according to claim 1 wherein the frame comprises a frame comprising first and second sidewalls spaced apart from and operably connected to one another, and wherein the tab is disposed between the first and second sidewalls.

3. A multipurpose tool according to claim 2 wherein the first handle further comprises an interconnect extending between the first and second sidewalls, and wherein the tab is connected to and extends from the interconnect.

4. A multipurpose tool according to claim 3 wherein the tab extends in a direction from the interconnect toward the carabiner.

5. A multipurpose tool according to claim 3 wherein the interconnect extends between respective edges of the first and second sidewalls, and wherein the tab is disposed interior of the respective edges and between medial portions of the first and second sidewalls.

6. A multipurpose tool according to claim 2 wherein the spring is positioned at least partially between the first and second sidewalls of the frame.

7. A multipurpose tool according to claim 6 wherein the engagement member of the spring extends in a direction away from the carabiner.

8. A multipurpose tool according to claim 1 wherein the tab is L-shaped.

9. A tool comprising:

at least a first handle including a carabiner defining an opening thereto, wherein the first handle is elongate so as to extend in a lengthwise direction between opposed ends;

at least one tool carried by the first handle;

a spring extending in the lengthwise direction and connected to the first handle proximate the carabiner; and a gate engaged by the spring to extend at least partially across the opening defined by the carabiner, wherein the first handle also includes a tab that extends in the lengthwise direction and the spring includes a corresponding engagement member configured to engage the tab such that the tab resists movement of the spring relative to the first handle.

10. A tool according to claim 9 wherein the first handle comprises a frame comprising first and second sidewalls spaced apart from and operably connected to one another, and wherein the tab is disposed between the first and second sidewalls.

11. A tool according to claim 10 wherein the frame further comprises an interconnect extending between the first and second sidewalls, and wherein the tab is connected to and extends from the interconnect.

12. A tool according to claim 11 wherein the tab extends in a direction from the interconnect toward the carabiner.

13. A tool according to claim 11 wherein the interconnect extends between respective edges of the first and second sidewalls, and wherein the tab is disposed interior of the respective edges and between medial portions of the first and second sidewalls.

14. A tool according to claim 10 wherein the spring is positioned at least partially between the first and second sidewalls of the frame.

15. A tool according to claim 14 wherein the engagement member of the spring extends in a direction away from the carabiner.

16. A tool according to claim 9 wherein the tab is L-shaped.

17. A handle assembly comprising:

a frame comprising first and second sidewalls spaced apart from and operably connected to one another, said frame also including a carabiner defining an opening thereto, wherein the frame is elongate so as to extend in a lengthwise direction between opposed ends;

a spring extending in the lengthwise direction and connected to the frame proximate the carabiner;

a gate engaged by the spring to extend at least partially across the opening defined by the carabiner, wherein the frame also includes a tab that extends in the lengthwise direction and the spring includes a corresponding engagement member configured to engage the tab such that the tab resists movement of the spring relative to the frame.

18. A handle assembly according to claim 17 wherein the tab is disposed between the first and second sidewalls.

19. A handle assembly according to claim 18 wherein the frame further comprises an interconnect extending between the first and second sidewalls, and wherein the tab is connected to and extends from the interconnect.

20. A handle assembly according to claim 19 wherein the tab extends in a direction from the interconnect toward the carabiner.

21. A handle assembly according to claim 19 wherein the interconnect extends between respective edges of the first and second sidewalls, and wherein the tab is disposed interior of the respective edges and between medial portions of the first and second sidewalls.

22. A handle assembly according to claim 18 wherein the spring is positioned at least partially between the first and second sidewalls of the frame.

23. A handle assembly according to claim 22 wherein the engagement member of the spring extends in a direction away from the carabiner.

24. A handle assembly according to claim 17 wherein the tab is L-shaped.

* * * * *